US009644853B2

(12) United States Patent
Kawano et al.

(10) Patent No.: US 9,644,853 B2
(45) Date of Patent: May 9, 2017

(54) PACKAGED ENGINE WORKING MACHINE

(75) Inventors: Tatsuya Kawano, Osaka (JP); Masaaki Ono, Osaka (JP); Keisuke Kawakita, Osaka (JP)

(73) Assignee: Yanmar Co., Ltd., Osaka-shi (JP)

( * ) Notice: Subject to any disclaimer, the term of this patent is extended or adjusted under 35 U.S.C. 154(b) by 875 days.

(21) Appl. No.: 13/985,472

(22) PCT Filed: Feb. 10, 2012

(86) PCT No.: PCT/JP2012/053110

§ 371 (c)(1),
(2), (4) Date: Aug. 14, 2013

(87) PCT Pub. No.: WO2012/111555

PCT Pub. Date: Aug. 23, 2012

(65) Prior Publication Data

US 2013/0316637 A1 Nov. 28, 2013

(30) Foreign Application Priority Data

Feb. 15, 2011 (JP) ..... 2011-029794

(51) Int. Cl.
*F24F 7/06* (2006.01)
*F24F 7/007* (2006.01)
(Continued)

(52) U.S. Cl.
CPC ..... *F24F 7/007* (2013.01); *F01P 1/00* (2013.01); *F02B 63/044* (2013.01); *F01P 2001/005* (2013.01)

(58) Field of Classification Search
CPC ..... F02B 63/04; F02B 63/044; F02B 63/048
See application file for complete search history.

(56) References Cited

U.S. PATENT DOCUMENTS 3,277,272 A * 10/1966 Rill ..... F24D 3/00 219/530
4,243,893 A * 1/1981 Sten ..... F01P 1/06 290/1 B (Continued)

FOREIGN PATENT DOCUMENTS

JP 61-92168 U 6/1986
JP S6192168 * 6/1986

(Continued)

OTHER PUBLICATIONS

Australian Search Report issued in counterpart Australian Application No. 2012218679 dated Feb. 5, 2016 (six pages).

(Continued)

*Primary Examiner* — Steven B McAllister
*Assistant Examiner* — Jonathan Cotov
(74) *Attorney, Agent, or Firm* — Crowell & Moring LLP

(57) ABSTRACT

There is provided a packaged engine working machine including, in a lower space of a package an electrical component storage box adapted to be impervious to heat from the engine and intrusion of dust or the like. In a packaged engine working machine in which an engine and a working machine driven by the engine are disposed in a lower space of a package, a storage box for storing a non-heat-generating electrical component included in electrical components for the engine and working machine, and a ventilation duct having a ventilation fan for sucking outside air into the lower space are each disposed in the lower space, and the packaged engine working machine includes an introduction path through which the ventilation duct and the storage box are communicated with each other, and the outside air sucked by the ventilation fan is partially guided into the storage box.

3 Claims, 11 Drawing Sheets

(51) Int. Cl.
*F01P 1/00* (2006.01)
*F02B 63/04* (2006.01)

(56) References Cited

U.S. PATENT DOCUMENTS

| | | | | | |
|---|---|---|---|---|---|
| 4,495,901 | A * | 1/1985 | Nannini | F02B 63/04 | 123/195 C |
| 4,736,111 | A * | 4/1988 | Linden | F02B 63/04 | 290/2 |
| 4,835,659 | A * | 5/1989 | Goodson | H04Q 1/14 | 361/724 |
| 5,649,418 | A * | 7/1997 | Ludwig | F02C 7/08 | 290/52 |
| 5,694,889 | A * | 12/1997 | Ball | F01P 1/02 | 123/41.7 |
| 5,899,174 | A * | 5/1999 | Anderson | F02B 63/04 | 123/2 |
| 6,784,574 | B2 * | 8/2004 | Turner | F02B 43/00 | 290/1 B |
| 2002/0121818 | A1 | 9/2002 | Turner et al. | | |
| 2003/0026557 | A1 * | 2/2003 | Galeotti | G02B 6/4237 | 385/94 |
| 2004/0252446 | A1 * | 12/2004 | Friedrich | H01H 85/2045 | 361/600 |
| 2005/0160740 | A1 * | 7/2005 | Nakano | F02C 7/12 | 60/796 |
| 2006/0054113 | A1 * | 3/2006 | Yasuda | F02B 63/04 | 123/41.65 |

FOREIGN PATENT DOCUMENTS

| | | | |
|---|---|---|---|
| JP | 1-125818 | U | 8/1989 |
| JP | 7-52665 | A | 2/1995 |
| JP | 8-68366 | A | 3/1996 |
| JP | 8-75308 | A | 3/1996 |
| JP | 10-184453 | A | 7/1998 |
| JP | 2002-242759 | A | 8/2002 |
| JP | WO02065620 | A1 * | 8/2002 |
| JP | 2005-155542 | A | 6/2005 |
| JP | 2005-264870 | A | 9/2005 |
| JP | 2006-312894 | A | 11/2006 |
| JP | 2007-224892 | A | 9/2007 |
| JP | 2008-82204 | A | 4/2008 |
| JP | 2009-144580 | A | 7/2009 |
| WO | WO 02/065620 | A1 | 8/2002 |

OTHER PUBLICATIONS

European Search Report dated May 8, 2015 (Five (5) pages).
International Preliminary Report on Patentability (PCT/IB/338) and PCT/IPEA/409) including English translation dated Aug. 15, 2013 (eight (8) pages).
Japanese-language Written Opinion of the International Preliminary Examining Authority (PCT/IPEA/408) dated Jan. 15, 2013 (Six (6) pages).
Japanese-language Preliminary Report on Patentability (PCT/IPEA/416) dated Apr. 16, 2013 (Seven (7) pages).
Japanese-language Written Opinion (PCT/ISA/237) dated Apr. 17, 2012 (Five (5) pages).
International Search Report dated Apr. 17, 2012 with English translation (Six (6) pages).

* cited by examiner

PACKAGED ENGINE WORKING MACHINE

TECHNICAL FIELD

The present invention relates to a packaged engine working machine in which an engine, a working machine driven by the engine, and electrical components for the engine and the working machine are stored inside a package.

BACKGROUND ART

A packaged engine working machine is known as a cogeneration apparatus in which a generator and/or a refrigerant compressor serving as working machine(s) are/is driven by an engine to perform electric power generation and/or heat pump air conditioning and to produce warm water by utilizing exhaust heat generated in electric power generation and/or heat pump air conditioning. Such a packaged engine working machine is adapted so that an engine, a working machine driven by the engine, and electrical components for the engine and the working machine are stored inside a package.

Electrical components used in a packaged engine working machine are stored in an electrical component box in order to prevent the electrical components from being exposed to heat and increased in temperature during engine operation.

For example, Patent Document 1 discloses an electrical component cooling apparatus for limiting temperature increase of electrical components such as a relay disposed inside an engine compartment of a vehicle.

PRIOR ART REFERENCE

Patent Document

Patent Document 1: Japanese Patent Application Laid-open No. H07-52665

SUMMARY

Technical Problem

When a relay box is disposed inside an engine compartment, the electrical component cooling apparatus disclosed in Patent Document 1 is adapted so that the relay box is provided as a portion of an intake path, and cooling air sucked by engine intake negative pressure is allowed to flow through the relay box, thereby cooling electrical components such as a relay stored in the relay box.

The electrical component cooling apparatus disclosed in Patent Document 1 has a negative pressure cooling structure in which the relay box is disposed upstream of an air cleaner and negative pressure cooling air sucked from a surrounding region is allowed to flow through the relay box; therefore, dust or the like is sucked together with cooling air, which disadvantageously causes intrusion of dust or the like into the relay box. In order to prevent such intrusion, the relay box has to be additionally provided with a dust-proof filter and maintenance thereof has to be performed, which will unfortunately contribute to cost increase.

Accordingly, the present invention solves the above-mentioned technical problems by providing a packaged engine working machine that includes, in a lower space of a package in which an engine is disposed, an electrical component storage box adapted so as to be impervious to heat from the engine and intrusion of dust or the like.

Solution to Problem

To solve the above-mentioned technical problems, the present invention provides the following packaged engine working machine.

Specifically, a packaged engine working machine of the present invention is a packaged engine working machine in which an engine and a working machine driven by the engine are disposed in a lower space of a package, wherein a storage box for storing a non-heat-generating electrical component included in electrical components for the engine and working machine, and a ventilation duct including a ventilation fan for sucking outside air into the lower space are each disposed in the lower space, and wherein the packaged engine working machine includes an introduction path through which the ventilation duct and the storage box are communicated with each other, and the outside air sucked by the ventilation fan is partially guided into the storage box.

In the packaged engine working machine of the present invention, the storage box is adapted so as to be hermetically-sealed.

In the packaged engine working machine of the present invention, the introduction path includes: an underfloor space provided below the lower space and communicated with the ventilation duct; and a communication pipe through which the underfloor space and the hermetically-sealed box are communicated with each other.

In the packaged engine working machine of the present invention, the underfloor space includes: an upper floor plate provided with a plurality of vent holes; and a lower floor plate disposed in parallel with the upper floor plate at a distance therefrom.

In the packaged engine working machine of the present invention, the non-heat-generating electrical component is at least one of a terminal block, a relay, a fuse and a breaker.

Advantageous Effects of the Invention

In the invention, although positive pressure outside air sucked by the ventilation fan in the ventilation duct tries to flow into the storage box disposed in the lower space through gaps of the storage box, the outside air is partially guided into the storage box through the introduction path through which the ventilation duct and the storage box are communicated with each other. Thus, the lower space in which the engine is disposed and an inner space of the storage box have equal positive pressures, and substantially no air moves between the lower space and the inner space. As a result, the present invention achieves the effect of preventing positive pressure air in the lower space from flowing into the storage box through gaps thereof, and preventing dust or the like from getting into the storage box together with the sucked outside air.

The invention enhances the effect of preventing the sucked outside air and dust or the like from getting into the storage box.

The introduction path may alternatively be provided in such a manner that a communication member branched off from the ventilation duct is communicated with the storage box through the lower space; however, in the invention, outside air passes through the underfloor space provided below the lower space in which the engine is disposed, and is then guided into the storage box, thus achieving the effect of preventing the outside air from being heated.

In the invention, outside air is allowed to flow out through the plurality of vent holes provided in the upper floor plate of the underfloor space, thus achieving the effect of effectively cooling the engine disposed in the lower space.

DESCRIPTION OF EMBODIMENTS

Hereinafter, a cogeneration apparatus 1 serving as a packaged engine working machine according to one embodiment of the present invention will be described in detail with reference to FIGS. 1 to 10. Note that the cogeneration apparatus 1 is a system in which an electric power transmission line to an electric power consumption device (load) is connected with a commercial power line for an external commercial power source and an electric power generation power line for a generator so as to cover the demand for electric power for the load and so as to recover exhaust heat incident to electric power generation to utilize the recovered heat.

Figure 1:
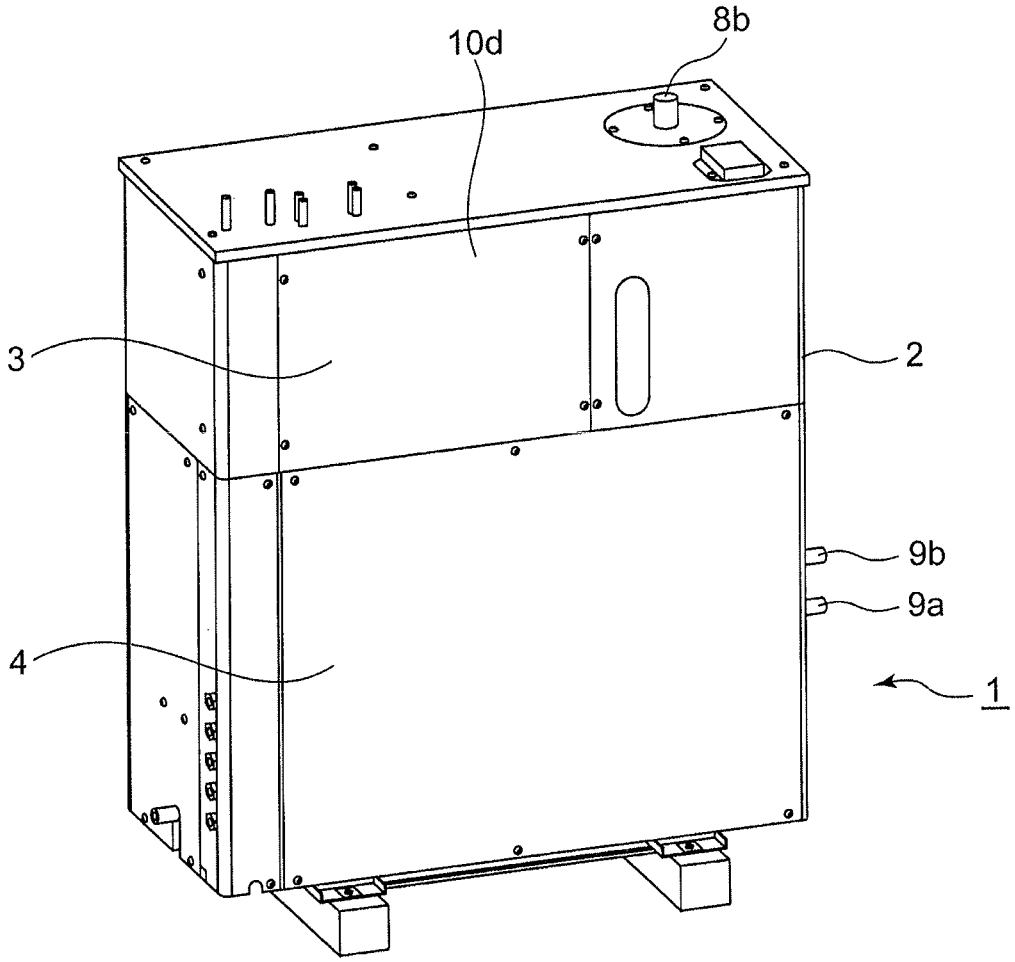
FIG. 1 is an overall front perspective view illustrating a cogeneration apparatus according to one embodiment of the present invention.
Figure 2:
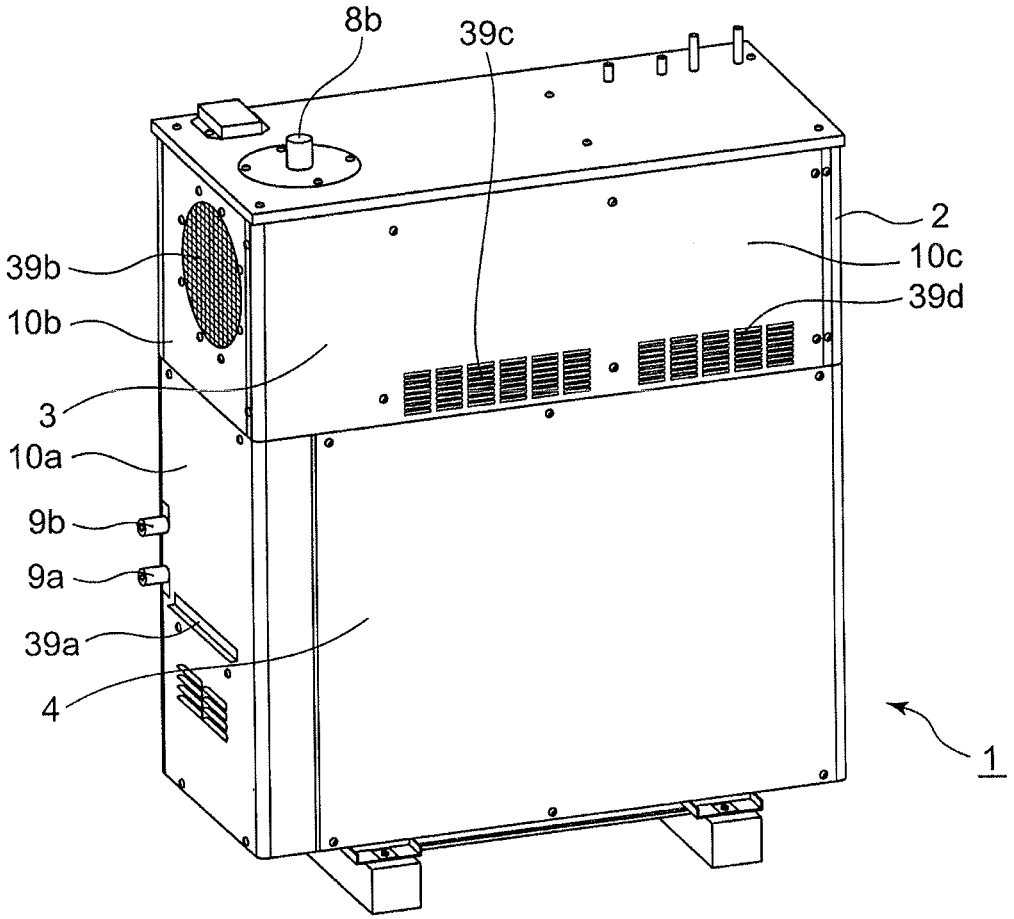
FIG. 2 is an overall rear perspective view illustrating the cogeneration apparatus.

As illustrated in FIGS. 1 and 2, the cogeneration apparatus 1 includes a substantially rectangular parallelepiped package (housing) 2. An outer surface of the package 2 is covered with a plurality of panels. As illustrated in FIG. 2, a right side lower panel 10*a* is provided with a ventilation intake port 39*a*, a right side upper panel 10*b* is provided with a ventilation exhaust port 39*b*, and a rear upper panel 10*c* is provided with an engine intake port 39*c* and an electrical component cooling intake port 39*d*. These air vents 39*a*, 39*b*, 39*c* and 39*d* each include a louver, perforated metal or a mesh.

Figure 4:
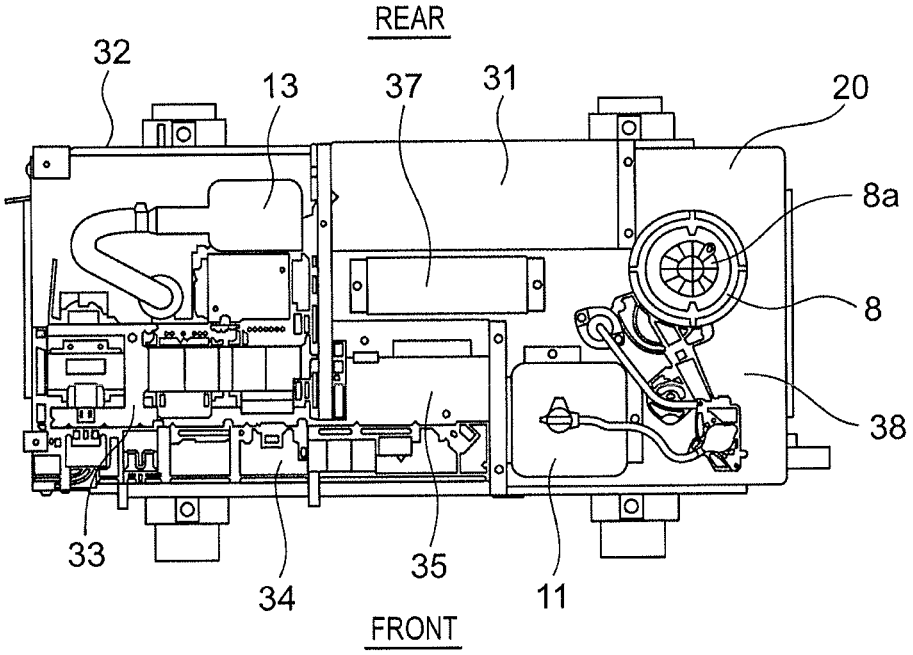
FIG. 4 is a plan view illustrating the inner structure of the cogeneration apparatus.
Figure 5:
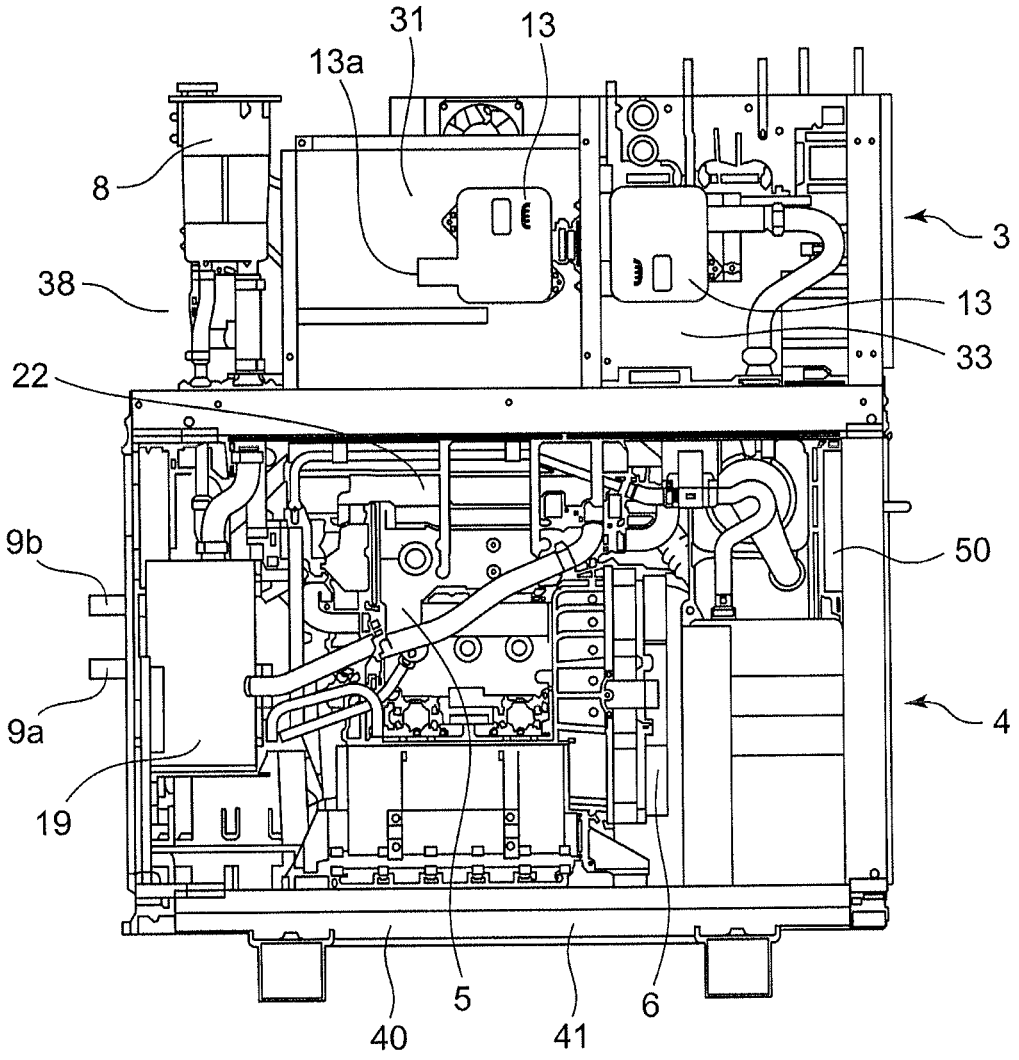
FIG. 5 is a rear view illustrating the inner structure of the cogeneration apparatus.

As illustrated in FIG. 3 and FIGS. 5 to 7, an inside of the package 2 is divided into two spaces, i.e., an upper space 3 and a lower space 4, by a middle wall 20 (illustrated in FIG. 4) located somewhere along a vertical direction of the package 2. As illustrated in FIGS. 4 to 7, the upper space 3 is partitioned by dividing walls into an intake chamber 31, a high heat generation chamber 33, a low heat generation chamber 34 and a device storage chamber 38. As illustrated in FIG. 5, an intake silencer 13 having an intake port 13*a* is disposed in the intake chamber 31, and another intake silencer 13 communicated with the intake silencer 13 in the intake chamber 31 is disposed in the high heat generation chamber 33; in addition, high heat generation components included in electrical components for an engine 5 and a generator 6 are collectively disposed in the high heat generation chamber 33. As illustrated in FIGS. 3 to 6, low heat generation components included in the electrical components for the engine 5 and the generator 6 are collectively disposed in the low heat generation chamber 34, and a mist separator 8 and a cooling water tank 11 are disposed in the device storage chamber 38.

Figure 3:
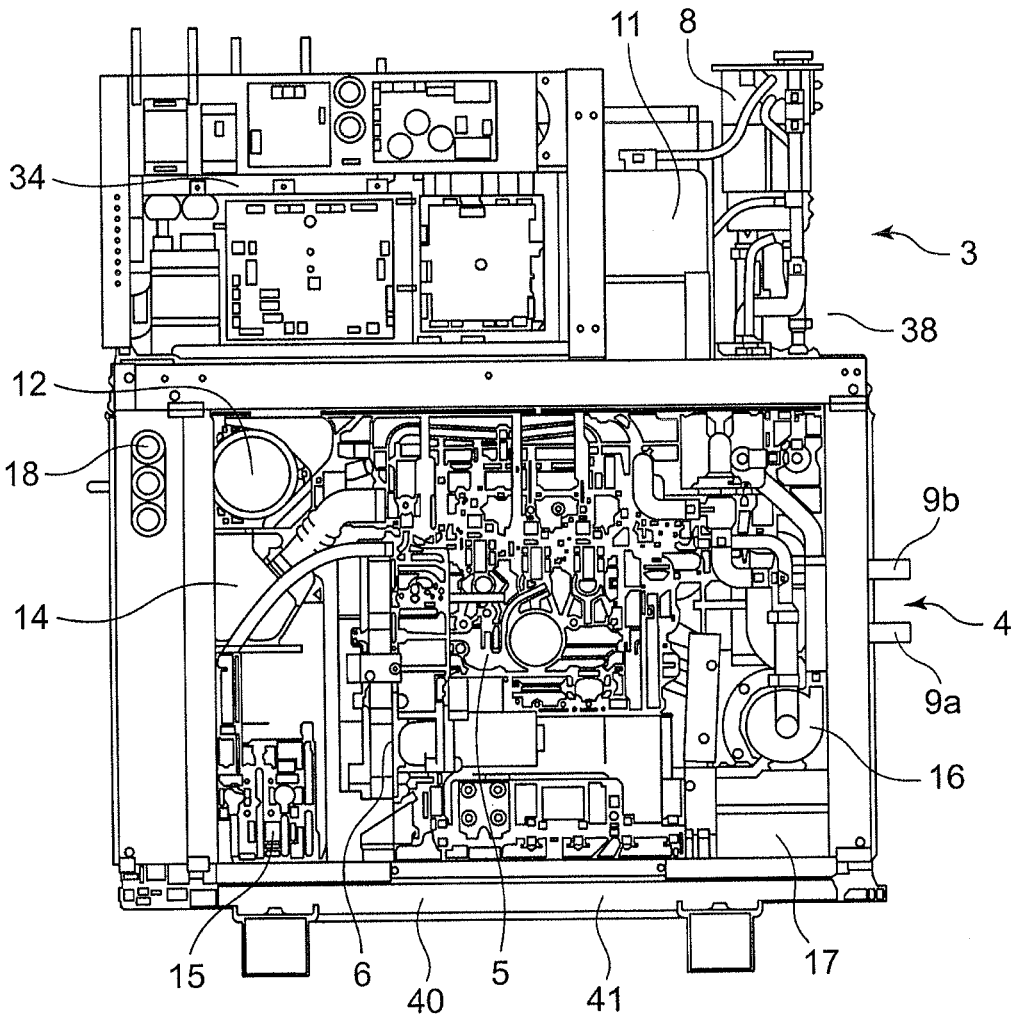
FIG. 3 is a front view illustrating an inner structure of the cogeneration apparatus.
Figure 6:
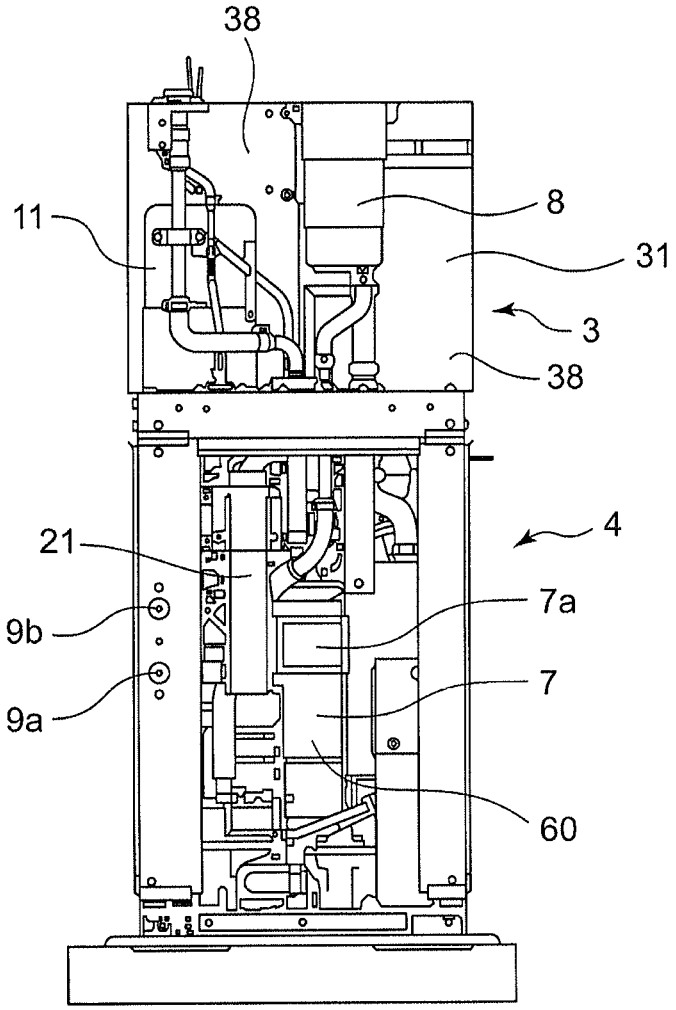
FIG. 6 is a right side view illustrating the inner structure of the cogeneration apparatus.
Figure 7:
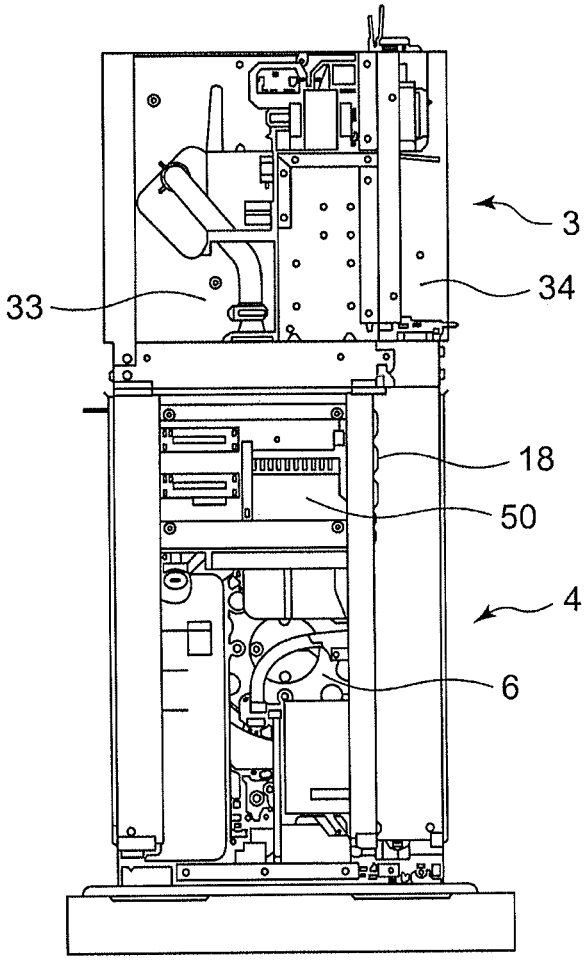
FIG. 7 is a left side view illustrating the inner structure of the cogeneration apparatus.

As illustrated in FIG. 3, the engine 5, the generator 6, an air cleaner 12, an intake silencer 14, a starting transformer (starter) 15, a cooling water pump 16 and a drain filter 17 are disposed in the lower space 4. As illustrated in FIG. 5, an exhaust silencer 19 and an exhaust gas heat exchanger 22 are disposed in the lower space 4. As illustrated in FIG. 6, a ventilation duct 60 and a water-water heat exchanger 21 are disposed in the lower space 4. As illustrated in FIG. 7, a storage box 50 is disposed in the lower space 4. Note that a gas engine, etc., is used as the engine 5. A crankshaft of the engine 5 is driven and rotated, which rotates a generator shaft of the generator 6 serving as a working machine, and thus generates electric power.

The above-mentioned water-water heat exchanger 21 and exhaust gas heat exchanger 22 serve to produce warm water by utilizing heat generated from the engine 5. As illustrated in FIGS. 3, 5 and 6, a water supply port 9*a* through which cold water is supplied to the heat exchangers 21 and 22, and a warm water outlet 9*b* through which warm water produced by the heat exchangers 21 and 22 is taken out are disposed vertically side by side at a right lateral surface of the lower space 4.

The storage box 50 illustrated in FIG. 7 stores, as a non-heat-generating electrical component, at least one of a terminal block 53, a relay, a fuse and a breaker. As illustrated in FIG. 3, three external wiring holes 18 through which external input wires and external output wires are connected to, for example, the terminal block 53 of the storage box 50 are disposed vertically side by side at an upper left end portion of the lower space 4.

As illustrated in FIG. 4, an air vent 37 through which the upper space 3 and the lower space 4 are communicated with each other vertically is provided in a substantially center region of the middle wall 20. Outside air taken into the lower space 4 through the ventilation duct 60 from the ventilation intake port 39*a* flows upward while cooling the engine 5, etc., flows into the device storage chamber 38 of the upper space 3 through the air vent 37, and is then discharged to an outside space from the ventilation exhaust port 39*b*.

Next, referring to FIGS. 8 to 10, how the engine 5 is cooled and how the storage box 50 is heat-insulated in the lower space 4 will be described.

Figure 8:
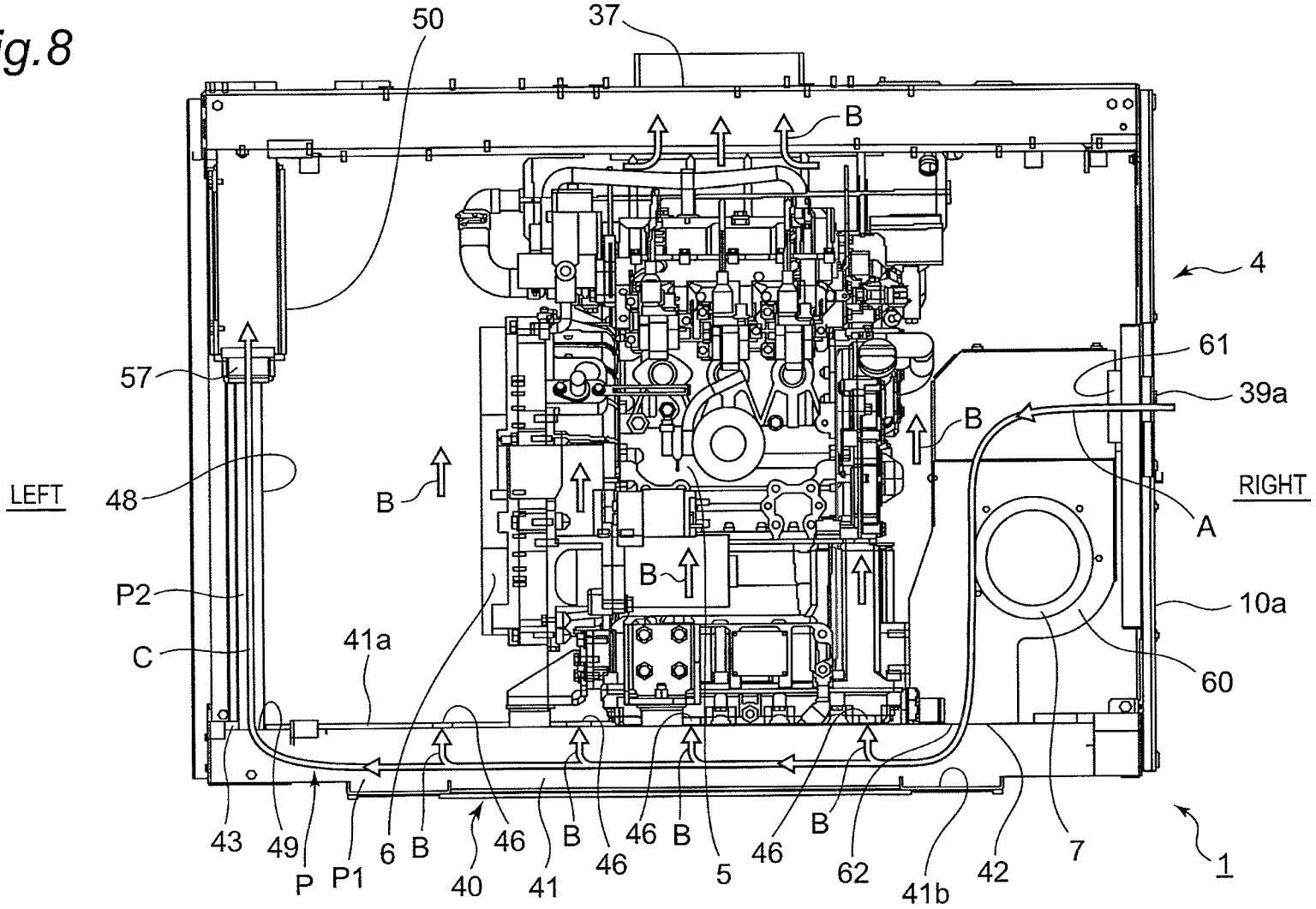
FIG. 8 is a front view schematically illustrating a lower space of the cogeneration apparatus.
Figure 9:
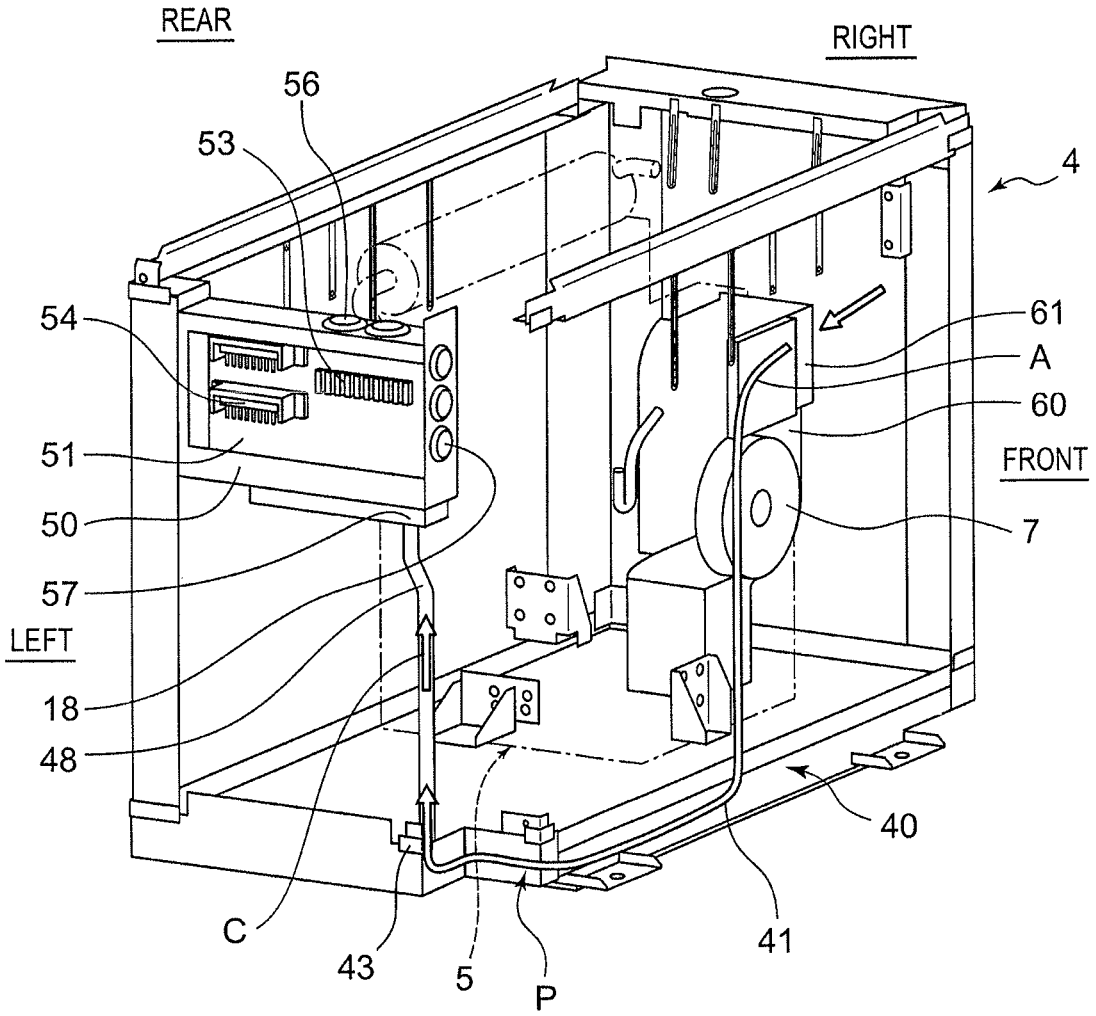
FIG. 9 is a front perspective view schematically illustrating the lower space of the cogeneration apparatus.
Figure 10:
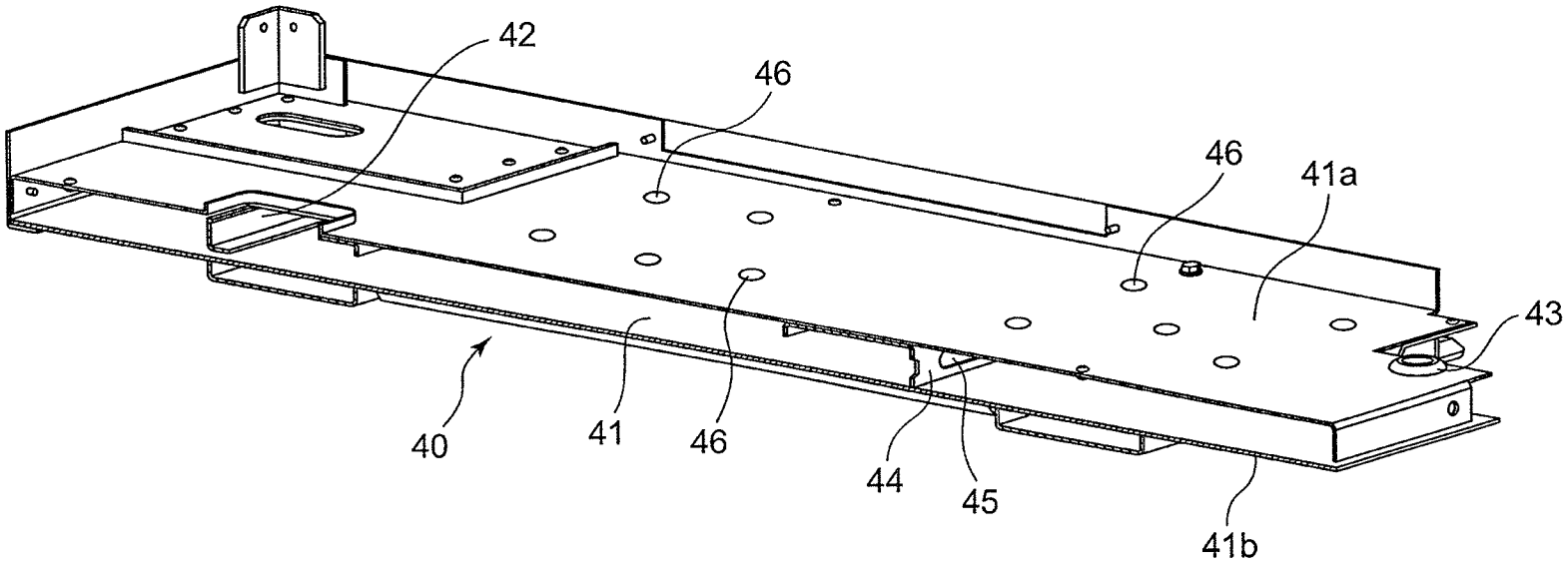
FIG. 10 is a cross-sectional view schematically illustrating a double bottom structure of the cogeneration apparatus.

As illustrated in FIGS. 8 and 9, a double floor structure 40 is provided below the lower space 4 of the package 2. As illustrated in FIG. 10, the double floor structure 40 includes: an upper floor plate 41*a* on which the engine 5, etc., is placed; and a lower floor plate 41*b* disposed in parallel with the upper floor plate 41*a* at a distance therefrom. An underfloor space 41 is provided between the upper floor plate 41*a* and the lower floor plate 41*b*.

As illustrated in FIG. 8, a vent opening 42 is provided at a position located in a right region of the upper floor plate 41*a* and facing a vent opening 62 of the ventilation duct 60. A ventilation connection end 43 is provided at a position located in a left region of the upper floor plate 41*a* and facing a vent opening 49 of a communication pipe 48. The upper floor plate 41*a* is provided with a plurality of appropriately sized and spaced vent holes 46 through which the lower space 4 and the underfloor space 41 are communicated with each other. As illustrated in FIG. 10, a support frame 44 for supporting, for example, the engine 5 placed on the upper floor plate 41*a* is appropriately disposed between the upper floor plate 41*a* and the lower floor plate 41*b*. An air vent 45 is provided at an appropriate position of the support frame 44, so that outside air is allowed to flow freely through the underfloor space 41.

As illustrated in FIGS. 8 and 9, the ventilation duct 60 through which outside air is taken in is disposed in a lower region of a right end of the lower space 4. A ventilation fan 7 for sucking outside air is disposed inside the ventilation duct 60. The ventilation fan 7 is driven and rotated by a not-illustrated motor. An upper end portion of the ventilation duct 60 includes an intake opening 61 adapted so as to face the ventilation intake port 39*a* provided in the right side lower panel 10*a* of the package 2. A lower end portion of the ventilation duct 60 includes the discharge opening 62 adapted so as to face the vent opening 42 provided in the upper floor plate 41*a* of the double floor structure 40.

As illustrated in FIGS. 8 and 9, the storage box 50 for storing a non-heat-generating electrical component such as the terminal block 53 is disposed in an upper region of a left end of the lower space 4 at a distance from the engine 5. The terminal block 53 for connection of a plurality of internal wires and external wires, and an attachment plate 51 for attachment of a fuse box 54, etc., into which a plurality of fuse elements are fitted and inserted are provided inside the storage box 50. At an upper surface of the storage box 50, a plurality of internal wiring holes 56 through which internal wires for connection with various devices and a control circuit unit stored inside the package 2 are connected to the terminal block 53 and the fuse box 54, etc., are disposed side by side from a front of the package 2 toward a rear thereof. At a front of the storage box 50, a plurality of the external wiring holes 18 through which the external input wires and external output wires are connected to, for example, the terminal block 53 of the storage box 50 are disposed vertically side by side. At a lower surface of the storage box 50, a ventilation connection end 57 for communication and connection with the communication pipe 48 in a hermetic state is provided. The storage box 50 has the plurality of internal wiring holes 56, the plurality of external wiring holes 18, and various screw attachment holes (not illustrated), but a not-illustrated sealing member, for example, is interposed, thus making it possible to maintain the inside of the storage box 50 in a hermetic state.

The communication pipe 48 extending vertically is provided between the storage box 50 and the double floor structure 40 so as to be located on a front side of a left end of the lower space 4. An upper end portion of the communication pipe 48 is connected to the ventilation connection end 57 of the storage box 50 in a hermetic state, and a lower end portion of the communication pipe 48 is connected to the ventilation connection end 43 of the upper floor plate 41*a* in a hermetic state. Accordingly, an intra-pipe path P2 leading to the storage box 50 from the lower end portion of the communication pipe 48 is also kept in a hermetic state. As a result, inner spaces of both of the storage box 50 and the communication pipe 48 can be kept in a hermetic state.

Next, how outside air A taken in from the ventilation intake port 39*a* by the ventilation fan 7 flows through the lower space 4 and the upper space 3 of the package 2 will be described.

Specifically, the outside air A taken in from the ventilation intake port 39*a* flows through the ventilation duct 60, i.e., through the intake opening 61, the ventilation fan 7 and the discharge opening 62 of the ventilation duct 60 in this order, and then reaches the underfloor space 41. The outside air A is introduced into the underfloor space 41 from the vent opening 42, and most of the outside air A is diverted as a cooling diverted flow B for cooling the engine 5 and the generator 6, etc. Then, the cooling diverted flow B having a positive pressure flows out from the plurality of vent holes 46 while being dispersed. The cooling diverted flow B, which has flowed out from the plurality of vent holes 46, cools the engine 5 and the generator 6, etc., while flowing upward, and is collected into the air vent 37. The cooling diverted flow B flows into the device storage chamber 38 of the upper space 3 from the air vent 37, and is discharged to the outside space from the ventilation exhaust port 39*b*.

The remainder of the outside air A which has gone past the downstream vent holes 46 is diverted as a positive pressure diverted flow C flowing into the storage box 50. The positive pressure diverted flow C flows through a downstream region of the underfloor space 41 to reach the ventilation connection end 43. The positive pressure diverted flow C is introduced into the communication pipe 48 from the vent opening 49, and flows upward through the communication pipe 48 to reach the ventilation connection end 57; then, the positive pressure diverted flow C is introduced into the storage box 50, thus allowing the inside of the storage box 50 to have a positive pressure. Specifically, the positive pressure diverted flow C is introduced into the storage box 50 along an introduction path P including an underfloor path P1 extending from the most upstream vent hole 46 to the ventilation connection end 43 inside the underfloor space 41 and the intra-pipe path P2 inside the most downstream communication pipe 48, thus allowing the inside of the storage box 50 to have a positive pressure.

In view of pressure loss or the like in various regions, opening sizes of the vent holes 46, the number thereof, and an inner diameter of the communication pipe 48, etc., are appropriately decided so that the cooling diverted flow B and the positive pressure diverted flow C have equal positive pressures. In the description concerning the positive pressure diverted flow C, the expression "the positive pressure diverted flow C flows" is used for the sake of clarity, but in reality, virtually no airflow occurs inside the storage box 50, etc., so that a positive pressure is merely propagated.

In the above-described embodiment, the cooling diverted flow B which has been diverted from the outside air A to cool the engine 5, etc., and has been increased in temperature tries to flow into the storage box 50 through gaps thereof, but the positive pressure diverted flow C having a positive pressure equal to that of the cooling diverted flow B is introduced into the storage box 50 to allow the inside of the storage box 50 to have a positive pressure, thus making it possible to prevent the cooling diverted flow B from flowing into the storage box 50. Therefore, it is possible to prevent waste heat of the engine 5, etc., from being transmitted to the inside of the storage box 50 via the cooling diverted flow B. Furthermore, virtually no airflow occurs between the inside and outside of the storage box 50, thus making it possible to prevent dust or the like contained in the cooling diverted flow B and the positive pressure diverted flow C from getting into the storage box 50.

Next, a cogeneration apparatus 1 according to a variation of the present invention will be described with reference to FIG. 11. The following description will focus on differences between the above-described embodiment and the variation.

In the above-described embodiment, the outside air A flows into the underfloor space 41, and is then diverted as the cooling diverted flow B and the positive pressure diverted flow C along the way. However, in the variation, outside air A1 is diverted as a cooling diverted flow B1 and a positive pressure diverted flow C1 while flowing out from a ventilation duct 60.

Figure 11:
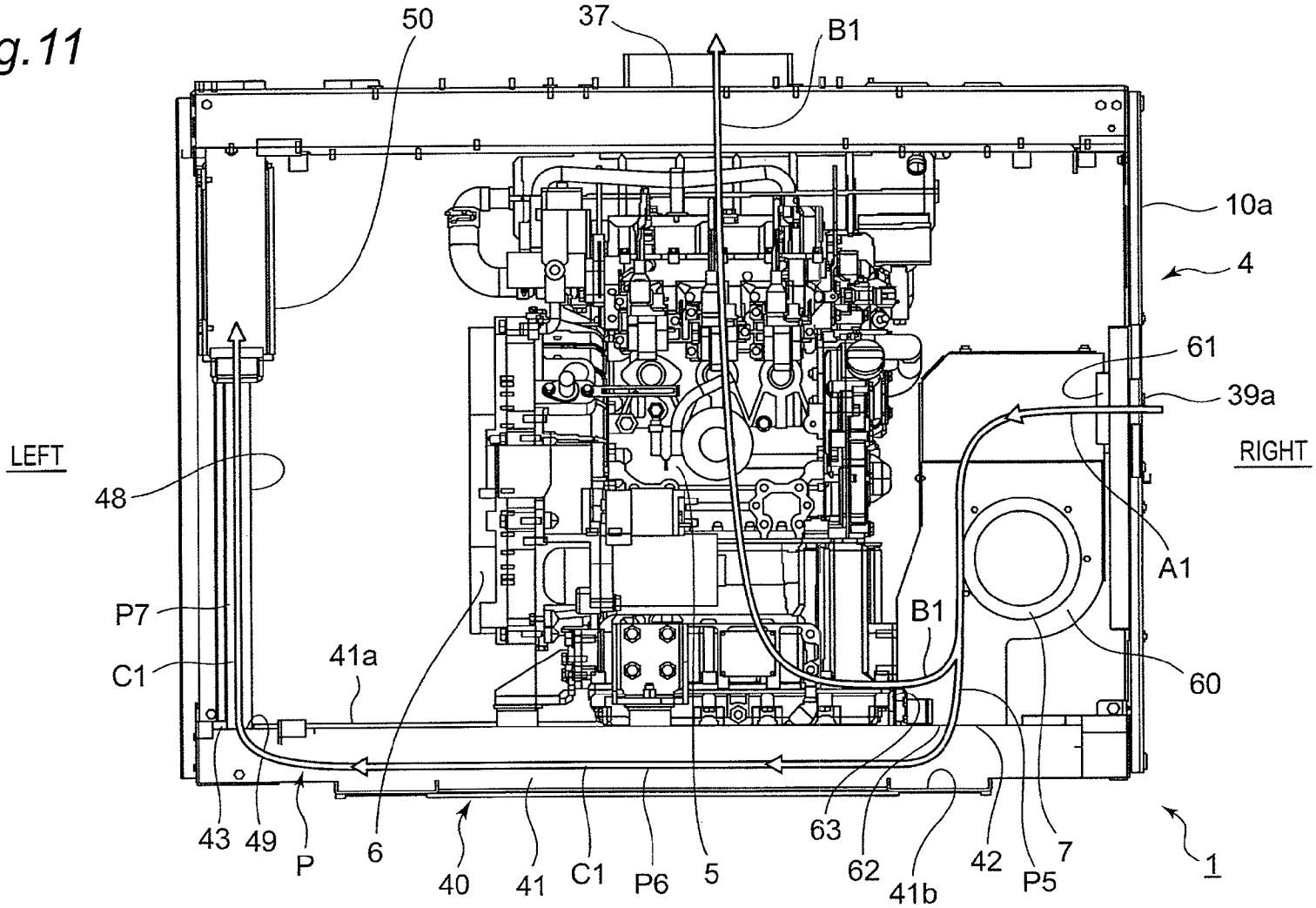
FIG. 11 is a front view schematically illustrating a lower space of a cogeneration apparatus according to a variation of the present invention.

FIG. 11 is a front view schematically illustrating a lower space 4 of the cogeneration apparatus 1 according to the variation. In FIG. 11, the ventilation duct 60 through which the outside air A1 is taken in is disposed in a lower region of a right end of the lower space 4. A ventilation fan 7 for sucking the outside air A1 is disposed inside the ventilation duct 60. The ventilation fan 7 is driven and rotated by a not-illustrated motor. An upper end portion of the ventilation duct 60 includes an intake opening 61 adapted so as to face a ventilation intake port 39*a* provided in a right side lower panel 10*a* of a package 2. A lower end portion of the ventilation duct 60 includes a discharge opening 62 adapted so as to face a vent opening 42 provided in an upper floor plate 41*a* of a double floor structure 40. The ventilation duct 60 further includes a discharge opening 63 adapted so as to face a lower right portion of an engine 5 and located between the ventilation fan 7 and the discharge opening 62. Since the discharge opening 63 for cooling the engine 5 and generator 6, etc., is provided in the ventilation duct 60, the plurality of vent holes 46 illustrated in FIGS. 8 and 10 are not provided in the upper floor plate 41*a*.

How the outside air A1 taken in from the ventilation intake port 39*a* by the ventilation fan 7 flows through the lower space 4 and upper space 3 of the package 2 in the cogeneration apparatus 1 illustrated in FIG. 11 will be described below.

The outside air A1 taken in from the ventilation intake port 39*a* flows through the ventilation duct 60, i.e., through the intake opening 61 and the ventilation fan 7 of the ventilation duct 60 in this order; then, at a region downstream of the ventilation fan 7 inside the ventilation duct 60, the outside air A1 is diverted as the cooling diverted flow B1 flowing to the discharge opening 63 and the positive pressure diverted flow C1 flowing to the discharge opening 62.

Most of the outside air A1 flows out from the discharge opening 63 as the cooling diverted flow B1 for cooling the engine 5 and the generator 6, etc. The cooling diverted flow B1 having a positive pressure cools the engine 5 and the generator 6, etc., while blowing against lower portions thereof and flowing upward. The cooling diverted flow B1 which has cooled the engine 5 and the generator 6, etc., and increased in temperature flows into a device storage chamber 38 of the upper space 3 from an air vent 37, and is then discharged to an outside space from a ventilation exhaust port 39*b*.

Meanwhile, the remainder of the outside air A1 which has gone past the discharge opening 63 is diverted as the positive pressure diverted flow C1 that will flow into a storage box 50, and reaches the discharge opening 62 while flowing further downstream inside the ventilation duct 60. The positive pressure diverted flow C1 is introduced into the underfloor space 41 from the vent opening 42, and flows through the underfloor space 41 in its longitudinal direction (i.e., from the right to the left in FIG. 11) to reach a ventilation connection end 43.

The positive pressure diverted flow C1 is introduced into a communication pipe 48 from a vent opening 49, and flows upward through the communication pipe 48 to reach a ventilation connection end 57; then, the positive pressure diverted flow C1 is introduced into the storage box 50, thus allowing the inside of the storage box 50 to have a positive pressure. Specifically, the positive pressure diverted flow C1 is introduced into the storage box 50 along an introduction path P including a duct path P5 extending from the discharge opening 63 to the discharge opening 62 inside the ventilation duct 60, an underfloor path P6 extending from the vent opening 42 to the ventilation connection end 43 inside the underfloor space 41, and an intra-pipe path P7 inside the communication pipe 48, thus allowing the inside of the storage box 50 to have a positive pressure. In view of pressure loss or the like in various regions, opening areas of the discharge opening 63 and the vent opening 42 and an inner diameter of the communication pipe 48, etc., are appropriately decided so that the cooling diverted flow B1 and the positive pressure diverted flow C1 have equal positive pressures.

Also in the description concerning the positive pressure diverted flow C1, the expression "the positive pressure diverted flow C1 flows" is used for the sake of clarity, but in reality, virtually no airflow occurs inside the storage box 50, etc., so that a positive pressure is merely propagated.

Also in the variation, the cooling diverted flow B1 which has been diverted from the outside air A1 to cool the engine 5, etc., and increased in temperature tries to flow into the storage box 50 through gaps thereof, but the positive pressure diverted flow C1 having a positive pressure equal to that of the cooling diverted flow B1 is introduced into the storage box 50 to allow the inside of the storage box 50 to have a positive pressure, thus making it possible to prevent the cooling diverted flow B1 from flowing into the storage box 50. Therefore, it is possible to prevent waste heat of the engine 5, etc., from being transmitted to the inside of the storage box 50 via the cooling diverted flow B. Furthermore, virtually no airflow occurs between the inside and outside of the storage box 50, thus making it possible to prevent dust or the like contained in the cooling diverted flow B1 and the positive pressure diverted flow C1 from getting into the storage box 50.

In the above-described embodiment and variation, outside air sucked by the ventilation fan 7 is passed through the underfloor space 41 provided below the lower space 4 and is introduced into the storage box 50. Alternatively, a communication member (not illustrated) through which the ventilation duct 60 and the storage box 50 are communicated to each other may be disposed in the lower space 4, so that outside air is passed through the communication member and introduced into the storage box 50.

The foregoing embodiment has been described on the assumption that the generator 6 is used as a working machine of the packaged engine working machine 1; however, when the packaged engine working machine 1 serves as an engine heat pump, a compressor is installed instead of the generator 6. Alternatively, both of the generator 6 and compressor may be installed as working machines of the packaged engine working machine 1.

DESCRIPTION OF THE REFERENCE CHARACTERS

1 cogeneration apparatus (packaged engine working machine)
2 package (housing)
3 upper space
4 lower space
5 engine
6 generator (working machine)
7 ventilation fan
39*a* ventilation intake port
40 double floor structure
41 underfloor space

48 communication pipe
46 vent hole
50 storage box
53 terminal block (non-heat-generating electrical component)
60 ventilation duct
A outside air
B cooling diverted flow
C positive pressure diverted flow
P introduction path

The invention claimed is:

1. A packaged engine working machine in which an engine and a working machine driven by the engine are disposed in a lower space of a package, wherein a storage box for storing a non-heat-generating electrical component included in electrical components for the engine and working machine, and a ventilation duct comprising a ventilation fan for sucking outside air into the lower space are each disposed in the lower space, and wherein an inner space of the storage box is hermetically sealed by interposing a sealing member for gaps of a plurality of internal wiring holes, a plurality of external wiring holes and various screw attachment holes provided in wall surfaces constituting the storage box, and the storage box and the ventilation duct are connected to each other by interposing a hermetical seal between the storage box and a communication pipe which connects the storage box with the ventilation duct, thus allowing the lower space and the inner space of the storage box to have equal positive pressure.

2. The packaged engine working machine according to claim 1, wherein an underfloor space provided below the lower space comprises: an upper floor plate provided with a plurality of vent holes; and a lower floor plate disposed in parallel with the upper floor plate at a distance therefrom.

3. The packaged engine working machine according to claim 1, wherein the non-heat-generating electrical component is at least one of a terminal block, a relay, a fuse and a breaker.

* * * * *